US008393266B2

(12) United States Patent
Rasmussen et al.

(10) Patent No.: US 8,393,266 B2
(45) Date of Patent: Mar. 12, 2013

(54) SYSTEMS AND METHODS APPLYING A DESIGN ON A MEDIUM

(75) Inventors: Michelle Mellor Rasmussen, Orem, UT (US); Adam M. Goodman, Orem, UT (US); Nathan A. Arnesen, Lehi, UT (US)

(73) Assignee: Lifestyle Crafts, LLC, Farmington, UT (US)

( * ) Notice: Subject to any disclaimer, the term of this patent is extended or adjusted under 35 U.S.C. 154(b) by 696 days.

(21) Appl. No.: 12/506,164

(22) Filed: Jul. 20, 2009

(65) Prior Publication Data

US 2011/0011290 A1 Jan. 20, 2011

(51) Int. Cl.
*B41F 19/02* (2006.01)
*B41F 17/00* (2006.01)

(52) U.S. Cl. ..... 101/4; 101/31.1; 101/35; 101/287

(58) Field of Classification Search ..... 101/287
See application file for complete search history.

(56) References Cited

U.S. PATENT DOCUMENTS

| | | | | | |
|---|---|---|---|---|---|
| 2,056,321 | A | | 10/1936 | Haumont | |
| 2,102,787 | A | * | 12/1937 | Christenson | 101/287 |
| 2,332,270 | A | | 4/1942 | Shaw | |
| 2,530,049 | A | * | 11/1950 | Ekblom | 101/287 |
| 2,747,505 | A | * | 5/1956 | Bailey | 101/287 |
| 3,209,686 | A | * | 10/1965 | Arthurs | 101/368 |
| 3,367,225 | A | | 2/1968 | Stanford et al. | |
| 3,372,482 | A | | 3/1968 | Mercorelli | |
| 3,402,101 | A | | 9/1968 | Schiel | |
| 3,754,327 | A | | 8/1973 | Lisa | |
| 3,850,059 | A | | 11/1974 | Kang | |
| 3,875,611 | A | | 4/1975 | Plisky et al. | |
| 3,896,721 | A | * | 7/1975 | See | 101/45 |
| 3,981,214 | A | | 9/1976 | Wich | |
| 4,092,890 | A | * | 6/1978 | Bousquet | 83/284 |
| 4,177,569 | A | | 12/1979 | Greer | |
| 4,226,664 | A | | 10/1980 | Shaffer | |
| 4,230,164 | A | | 10/1980 | Mericle | |
| 4,248,820 | A | | 2/1981 | Haataja | |
| 4,597,326 | A | | 7/1986 | Kultaranta | |
| 4,637,310 | A | | 1/1987 | Sato et al. | |
| 4,767,393 | A | | 8/1988 | Smith | |

(Continued)

FOREIGN PATENT DOCUMENTS

WO WO 03/016035 A1 2/2003

OTHER PUBLICATIONS

M.E. Williams, DIY Definitions: Print Gocco, http://www.diylife.com/2007/12/14/diy-definitions-print-gocco/, Dec. 14, 2007, (visited) Nov. 3, 2009, 5 pages.

(Continued)

*Primary Examiner* — Jill Culler
(74) *Attorney, Agent, or Firm* — Phillips Ryther & Winchester; Jared L. Cherry

(57) ABSTRACT

Disclosed herein are systems and methods for applying a design on a medium. In some embodiments, the system includes a letterpress assembly having a base and platen that may be configured in an open configuration and a closed configuration. In the open configuration, the base receives the medium and the platen receives a printing plate. The printing plate may include the design to be applied to the medium. A roller assembly may then receive the letterpress assembly in the closed configuration and may exert a compressive force on the letterpress assembly. The compressive force brings the medium into contact with the printing plate and applies the design on the medium.

21 Claims, 10 Drawing Sheets

U.S. PATENT DOCUMENTS 4,823,659 A 4/1989 Falasconi
4,858,317 A 8/1989 Seib et al.
5,038,651 A 8/1991 Burdick
5,211,108 A 5/1993 Gore et al.
5,297,405 A 3/1994 Manning et al.
5,298,701 A 3/1994 Sandor
5,319,430 A 6/1994 DeBolt et al.
5,384,964 A 1/1995 McKay
5,505,109 A 4/1996 Okonski et al.
5,505,132 A * 4/1996 Warren et al. ..... 101/371
5,526,573 A 6/1996 Peters et al.
5,553,375 A 9/1996 Powers
5,562,031 A 10/1996 Garner et al.
5,570,620 A 11/1996 Okonski et al.
5,577,328 A 11/1996 Kerry, Sr.
5,580,417 A 12/1996 Bradshaw
5,647,260 A 7/1997 Nabity
5,685,182 A 11/1997 Chhatwal
5,697,277 A 12/1997 Okonski et al.
5,701,789 A 12/1997 Okonski
5,722,319 A * 3/1998 Hirano ..... 101/23
5,735,997 A 4/1998 Reinders
5,768,769 A 6/1998 Shamblin
5,775,564 A 7/1998 Ilmarinen
5,778,748 A 7/1998 Beijen
5,782,156 A 7/1998 Collins
5,957,047 A * 9/1999 Kodama et al. ..... 101/126
5,961,779 A 10/1999 Bradshaw
6,007,754 A 12/1999 Crawford et al.
6,026,725 A 2/2000 Okonski
6,032,565 A 3/2000 Okonski et al.
6,041,506 A 3/2000 Iwao
6,052,909 A 4/2000 Gardner
6,076,444 A 6/2000 Okonski
6,109,152 A 8/2000 Hecht
6,112,425 A 9/2000 Nelson et al.
6,119,570 A 9/2000 Okonski
6,158,133 A 12/2000 Carlson et al.
6,220,136 B1 4/2001 Benes et al.
6,231,492 B1 5/2001 Graag
RE37,345 E 9/2001 Bradshaw et al.
6,301,866 B1 10/2001 Marshall et al.
6,321,457 B1 11/2001 Lariviere, Jr. et al.
6,361,483 B1 3/2002 Kirchner
6,387,201 B1 5/2002 Stuart et al.
6,419,794 B2 7/2002 Kustermann
6,458,269 B1 10/2002 Bassett et al.
6,467,853 B1 10/2002 Swartzendruber et al.
6,523,592 B2 2/2003 Kuki
6,543,355 B1 4/2003 Stiel
6,550,516 B2 4/2003 Moriguchi et al.
6,575,068 B2 6/2003 Lira-Nunez et al.
6,578,618 B2 6/2003 Muraki et al.
6,595,132 B2 7/2003 Junghans
6,619,195 B2 9/2003 Corcoran et al.
6,626,965 B2 9/2003 Workman et al.
6,647,875 B2 11/2003 Horikoshi
6,658,978 B1 12/2003 Johnson
6,668,461 B2 12/2003 Gardner
6,675,689 B2 1/2004 Nunez et al.
6,675,854 B2 1/2004 Worth
6,675,855 B1 1/2004 Lemens
6,708,413 B2 3/2004 Carlson et al.
6,718,872 B2 4/2004 Kanno
6,805,179 B2 10/2004 Velasquez et al.
6,813,839 B2 11/2004 McLean et al.
6,832,639 B2 12/2004 Lemens et al.
6,862,779 B1 3/2005 Lu et al.
6,918,332 B1 7/2005 Andersen
D508,701 S 8/2005 Corcoran et al.
7,055,427 B2 6/2006 Caron
7,117,658 B2 10/2006 Malini
7,127,987 B2 * 10/2006 Criss ..... 101/28
7,217,068 B2 5/2007 Oettle
7,469,634 B2 12/2008 Caron et al.
7,546,800 B2 6/2009 Caron
7,743,700 B2 * 6/2010 Ayala et al. ..... 100/176
2002/0000143 A1 1/2002 Okonski
2003/0070313 A1 4/2003 Romer
2004/0099113 A1 5/2004 Hixon et al.
2004/0112196 A1 6/2004 Corcoran et al.
2005/0083393 A1 4/2005 Murray et al.
2005/0126407 A1 6/2005 Hixon et al.

OTHER PUBLICATIONS

David S. Rose/Five Roses Press/New York, NY, Introduction to Letterpress Printing, http://www.fiveroses.org/intro.htm, Revision: Oct. 1, 2005, (visited) Nov. 3, 2009, 12 pages.
Frivmo, Letterpress and the Death of Print Design, http://blog.frivolousmotion.com/2007/12/letterpress-and-death-of-print-design,html, Dec. 10, 2007, (visited) Nov. 3, 2009, 3 pages.
Wikipedia, Letterpress printing, http://en.wikipedia.org/wiki/Letterpress_printing, (last modified) Oct. 23, 2009, (visited) Nov. 3, 2009, 6 pages.
Dolcepress, Making your own based for photopolymer plates, http://dolcepress.com/blog/2007/10/, Oct. 2007, (visited) Nov. 3, 2009, 5 pages.
Fiveprime, The World's Best Photos of adana and letterpress, Flickr Hive Mind, http://fiveprime.org/hivemind/Tags/adana.letterpress, (visited) Nov. 3, 2009.
Briarpress, All presses, http://www.briarpress.org/museum/browse, (visited) Nov. 3, 2009, 4 pages.
ABC Extreme Makeover Home Edition, ABC's Extreme Makeover: Home Edition showcases letterpress printing in the first episode of the New Year, http://www.fiveroses.org/extreme.htm, (visited) Nov. 3, 2009, 2 pages.
EBAY, Choosing a letterpress printing press, http://reviews.ebay.com/Choosing-a-letterpress-printing-press_W0QQugidZ10000000001235854, (visited) Nov. 3, 2009, 4 pages.

* cited by examiner

SYSTEMS AND METHODS APPLYING A DESIGN ON A MEDIUM

DETAILED DESCRIPTION OF PREFERRED EMBODIMENTS

Figure 1A:
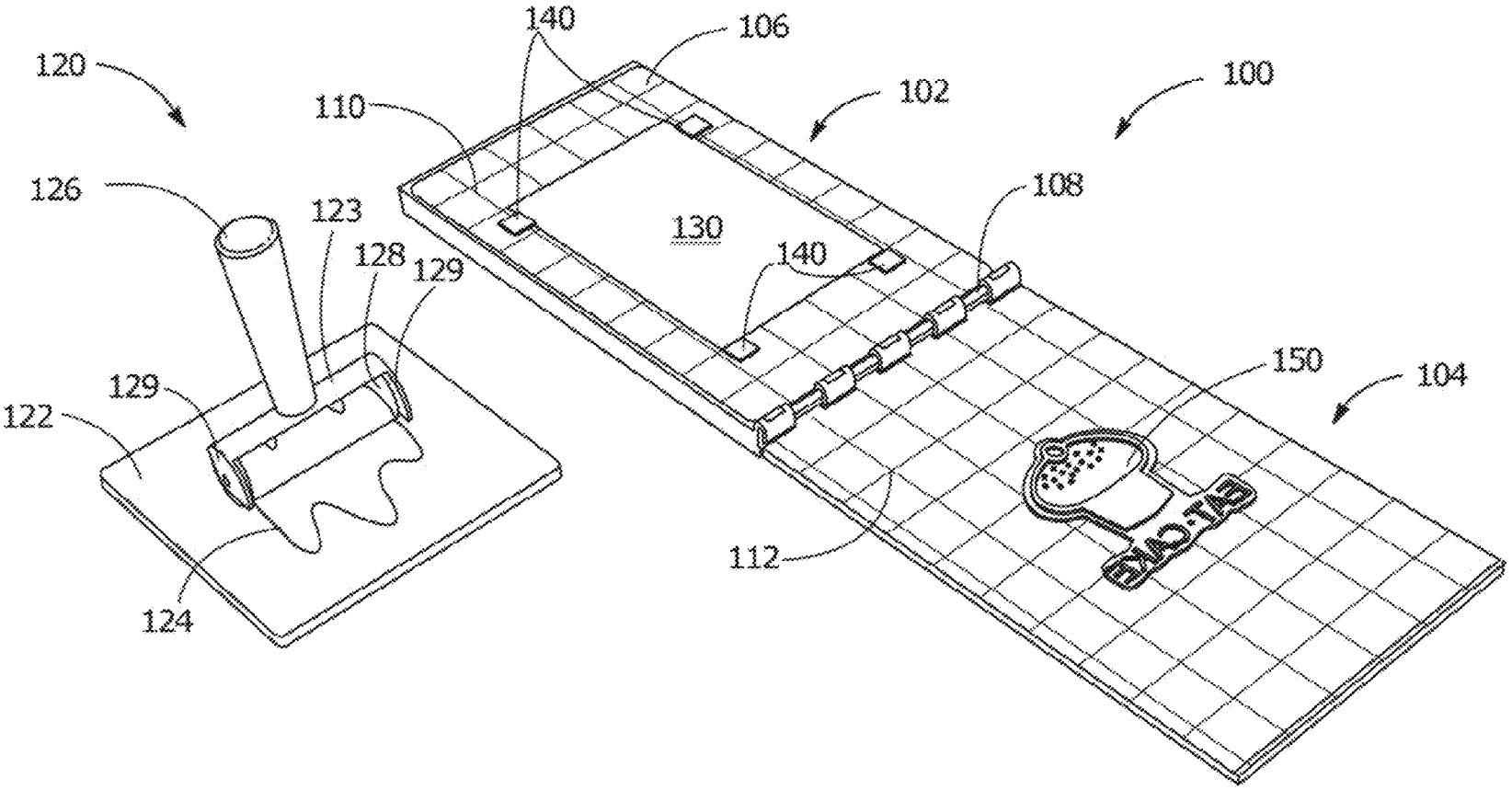
FIG. 1A illustrates a perspective view of one embodiment of a system including a letterpress assembly in an open configuration, an ink brayer, a printing plate, an ink plate, and a plurality of spacing members.

In the following description, numerous specific details are provided for a thorough understanding of the various embodiments of the invention. However, those skilled in the art will recognize that the invention can be practiced without one or more of the specific details, or with other methods, components, materials, etc. In addition, in some cases, well-known structures, materials, or operations may not be shown or described in detail in order to avoid obscuring aspects of the invention. Furthermore, the described features, structures, or characteristics may be combined in any suitable manner in one or more alternative embodiments.

Disclosed herein are systems and methods for applying a design on a medium. In some embodiments, the system includes a letterpress assembly having a base and platen that may be positioned in an open configuration and a closed configuration. In the open configuration, the base may receive the medium and the platen may receive a printing plate. For ease of reference throughout this description, a surface of the letterpress assembly that receives the medium is referred to as the base, and a surface of the letterpress assembly that receives the printing plate is referred to as the platen. As will be appreciated, however, the platen and the base may be reversed. The base may receive the printing plate and the platen may receive the medium. More generically, the letterpress assembly may be referred to as having a first surface configured to receive the medium and a second surface configured to receive the printing plate. The surfaces may be functionally interchangeable.

The printing plate may include the design to be applied on the medium. A design may be applied to a medium by either printing the design on the medium or impressing the design on the medium. A design may be impressed on the medium by either embossing the design on the medium or debossing the design on the medium. The design is debossed on the medium when the design is indented into the surface of the medium, while the design is embossed on the medium when the design is raised from the surface of the medium.

A roller assembly may be configured to receive the letterpress assembly in a closed configuration and to exert a compressive force on the letterpress assembly. The compressive force brings the medium into contact with the printing plate and applies the design on the medium. In certain embodiments, a spacing member may be disposed between the base and the platen in the closed configuration to maintain a separation between the printing plate and the medium and/or to assist in positioning the medium at a desired location. In some embodiments, a hinge may connect the platen and the base, and the hinge may be configured to allow a vertical travel of the platen relative to the base with the platen substantially parallel to the base to provide for a more even compressive force.

As used herein, an open configuration of the letterpress assembly refers to any configuration of the letterpress assembly in which the base and the platen are sufficiently separated that a medium may be readily placed on or removed from the base or a printing plate may be readily affixed to or removed from the platen. A closed configuration of the letterpress assembly refers to any configuration in which the base and the platen are sufficiently proximate that a medium and/or a printing plate may not be readily placed on or removed from the base or a printing plate may not be readily affixed to or removed from the platen and in which the letterpress assembly is in position to be compressed to apply a design.

In certain embodiments, an ink brayer may be used to apply ink to the printing plate. The ink brayer may include guides that maintain the ink brayer at the appropriate height when applying ink to the printing plate. When the ink brayer is not in use, the guides may also elevate the ink brayer from a table or other surface on which the brayer is placed. In this way, the guides may also help prevent ink from being inadvertently transferred to a table or other working surface.

FIG. 1A illustrates a perspective view of one embodiment of a letterpress assembly 100, an ink brayer 120, and an ink plate 122. Letterpress assembly 100 is illustrated in an open configuration. Letterpress assembly 100 includes a base 102 and a platen 104 connected by a hinge 108. Hinge 108 allows platen 104 and base 102 to be positioned in an open configuration, as shown in FIG. 1A, or a closed configuration, as shown in FIG. 1C. In the open configuration, a medium 130 may be received on base 102 and a printing plate 150 may be received on platen 104.

Medium 130 may comprise any of a variety of materials, including but not limited to paper, fabric, wood, ceramic, leather, plastic, metal, foil, clay, and the like, along with combinations of the foregoing materials. In certain embodiments where paper is the medium, the paper may be thick and light with a soft texture. In some embodiments, medium 130 may be positioned between a plurality of spacing members 140. In some implementations, spacing members 140 may also be compressible. As illustrated in FIG. 1A, spacing members 140 are disposed immediately adjacent to medium 130. Spacing members 140 may be affixed in a desired location, and may then serve as a guide for positioning medium 130 at a desired location on base 102. Spacing members 140 may, in some embodiments, be permanently affixed to base 102. In other embodiments, spacing members 140 may be temporarily affixed to base 102 and readily removed from or rearranged on base 102 to accommodate alternative media of different sizes. By using spacing members 140 as guides, a series of printed media may be generated that are approximately uniform in the position of the design on each medium 130 of the series. Spacing members 140 may comprise any of a variety of materials, including but not limited to foam, rubber, plastic, silicon, and the like. In one embodiment, spacing members 140 may be compressible by at least 50%. In this embodiment, spacing members 140 may allow for the creation of a clear impression of printing plate 150 on medium 130, while also preventing printing plate 150 from inadvertently coming into contact with medium 130.

Printing plate 150 may include a design to be applied on medium 130. A design may be of any type, including images and/or text. In the illustrated embodiment, printing plate 150 includes both an image and text. As illustrated in FIG. 1A, a design (e.g. text or image) on printing plate 150 is reversed, so that when the design from printing plate 150 is transferred to medium 130 the design will be properly oriented. A plurality of printing plates may be disposed on platen 104, and a plurality of designs may be contemporaneously transferred to medium 130. In certain embodiments, a fastener is disposed on one side of printing plate 150 and a design is disposed on the other side. A variety of types of fasteners may be used, including an adhesive, a hook, and a snap. The adhesive may be a low-tack adhesive, and may allow printing plate 150 to be repeatedly adhered to and removed from platen 104. Using any of the above-listed fasteners, printing plate 150 may be repositioned and reused. Printing plate 150 may comprise a variety of materials, including but not limited to a molded plastic plate, a chemically-etched plate, a machined plastic plate, and a photopolymer plate.

In certain embodiments, base 102 may receive a packing mat 106. Packing mat 106 may be fabricated of paper, plastic, metal, rubber, and the like. In certain embodiments, packing mat 106 may be replaceable in order to allow a user to select a desired hardness and thickness of packing mat 106 for a particular application. A thicker packing mat 106 may cause a deeper impression when compared to a thinner packing mat 106. Similarly, a harder packing mat 106 may provide a deeper impression when compared to a softer packing mat 106.

In certain embodiments, platen 104 and/or base 102 may be at least partially transparent. In such embodiments, a user may visually confirm the position or registration of printing plate 150 with respect to medium 130 before the design is applied on medium 130. Further, certain embodiments may include a grid 110 on packing mat 106 and/or a grid 112 on platen 104. Grids 110 and 112 may be configured such that at least a portion of grid 110 aligns with at least a portion of grid 112 when letterpress assembly 100 is in the closed configuration (shown in FIG. 1C). In some embodiments, grid 110 may be identical to grid 112. Using grids 110 and 112, a user may be able to position printing plate 150 and medium 130 in desired locations to precisely align the position of printing plate 150 with respect to a desired printing location on medium 130 without needing to close letterpress assembly 100 in order to view the position of printing plate 150 with respect to medium 130.

In certain embodiments, packing mat 106 may be configured such that one side of medium 130 is oriented toward printing plate 150, while the other side is oriented toward packing mat 106. When medium 130 is brought into contact with printing plate 150, the side oriented toward printing plate 150 is impressed by printing plate 150. The other side of medium 130 oriented toward packing mat 106 may remain substantially flat due to the hardness of packing mat 106.

Ink brayer 120 may be used to apply an ink 124 to printing plate 150. Brayer 120 may include a handle 126, a support member 123, a cylinder 128, and guides 129. Ink may be initially placed on ink plate 122. Brayer 120 may roll ink 124 into an evenly distributed layer on ink plate 122. In the process of spreading ink 124 on ink plate 122, ink 124 is also evenly distributed on cylinder 128. Ink 124 may be water, oil, rubber, or soy based. In certain embodiments, ink 124 is thick and tacky. The tacky consistency may result in a clean transfer of ink from printing plate 150 to medium 130. Of course, in some implementations, a design may be applied to a medium without printing the design on the medium. In other words, a user may use printing plate 150 to impress (e.g., emboss or deboss) a design on medium 130 without applying ink.

As described in greater detail below regarding FIGS. 5B and 5C, guides 129 may also serve to maintain cylinder 128 at the appropriate height when applying ink 124 to printing plate 150. By maintaining an appropriate height, ink 124 may be applied evenly to printing plate 150, and application of ink to the edges of printing plate 150 and platen 104 may be reduced. In some implementations, a variety of separate brayers may be provided, each having guides of different heights that are configured for use with different printing plates. Alternatively, a brayer having adjustable guides may be provided. When brayer 120 is not in use, guides 129 may also elevate cylinder 128 from a table or other surface on which brayer 120 may be placed. By elevating cylinder 128, guides 129 may help prevent ink 124 from being inadvertently transferred to a table or other working surface.

Figure 1B:
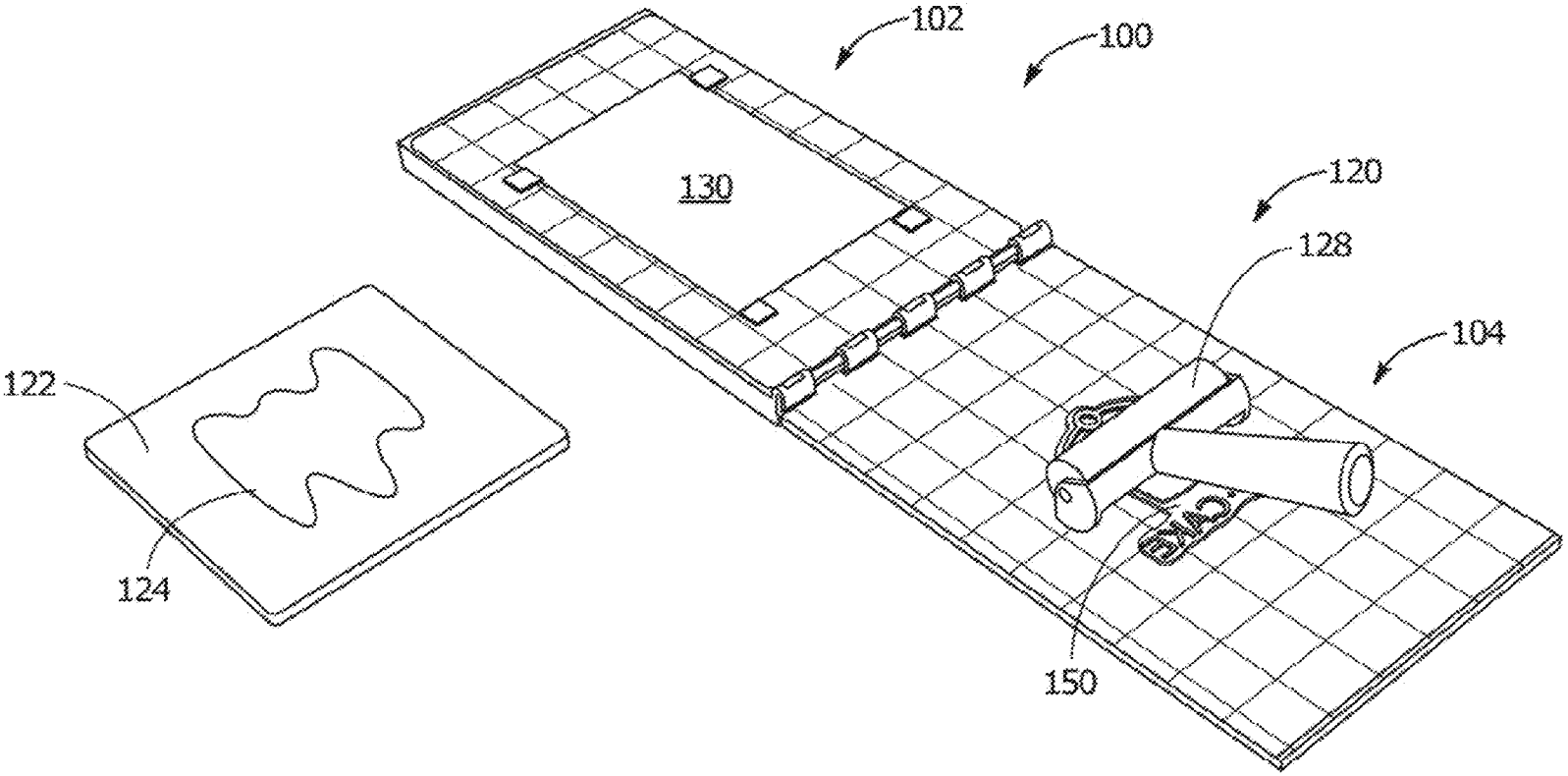
FIG. 1B illustrates a perspective view of the system illustrated in FIG. 1A, in which ink is being applied to the printing plate using the ink brayer.
Figure 1C:
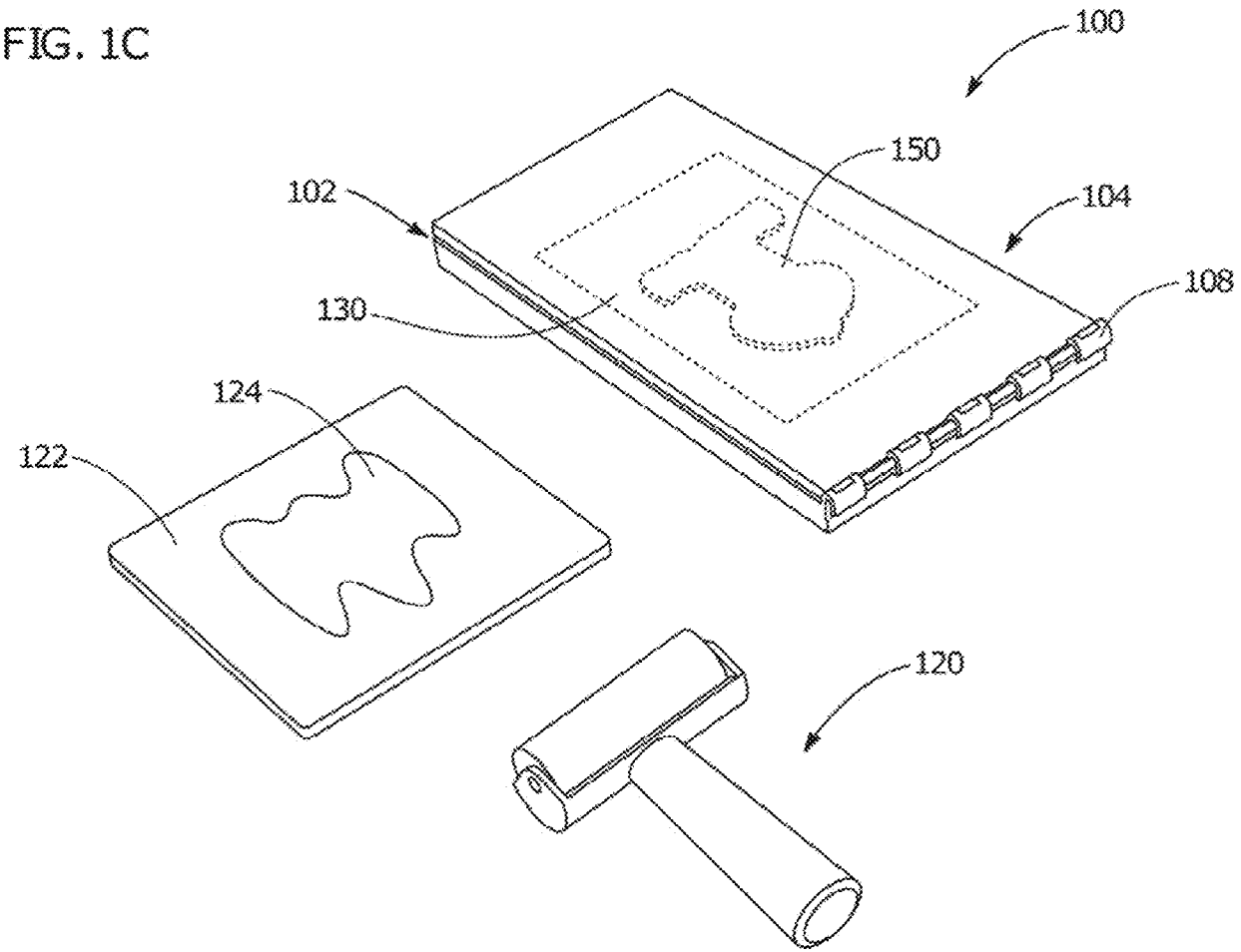
FIG. 1C illustrates a perspective view of the system illustrated in FIG. 1A, in which the letterpress assembly is in a closed configuration.

FIG. 1B illustrates the process of applying ink 124 to printing plate 150. When cylinder 128 has ink disposed on its surface, it may be used to apply ink to printing plate 150. As illustrated, printing plate 150 may receive the ink when it is disposed on platen 104. In alternative embodiments, ink may be applied to printing plate 150 in other ways. For example, ink may be applied to printing plate 150 before printing plate 150 is affixed to platen 104 using, for example, an ink pad (not shown). Ink 124 may be a variety of colors, and a user may, if desired, use multiple colors of ink to print a multi-colored design on medium 130. In some embodiments, multiple colors of ink 124 may be mixed on ink plate 122 to create custom colors or shades.

FIG. 1C illustrates that once printing plate 150 has been inked and affixed to platen 104, letterpress assembly 100 may be reconfigured in the closed configuration. In the illustrated embodiment, hinge 108 allows letterpress assembly to be configurable in the open configuration (shown in FIGS. 1A and 1B) and the closed configuration (shown in FIG. 1C). Other mechanisms for configuring letterpress assembly 100 that do not include a hinge 108 are also contemplated. For example, base 102 and platen 104 may be separable and may include a mechanism for aligning base 102 and platen 104. Alternatively, the base and platen may be entirely separate pieces that may be approximated together during use. In certain embodiments, platen 104 may be disposed substantially in parallel to base 102 in the open configuration. Platen 104 and base 102 may be separated in a vertical direction, and may be approximated using gears, levers, or other mechanisms.

Figure 2A:
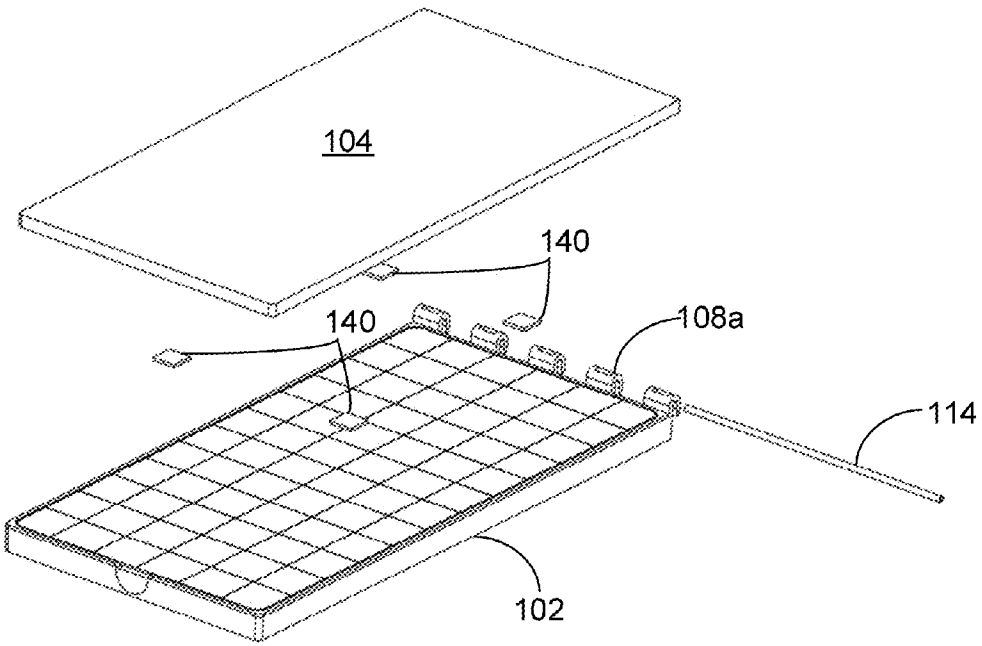
FIG. 2A illustrates an exploded perspective view of the letterpress assembly illustrated in FIG. 1A, along with a plurality of spacing members.

FIG. 2A illustrates an exploded view of letterpress assembly 100 and spacing members 140. A hinge pin 114, which is part of letterpress assembly 100, is also shown removed from hinge 108. As illustrated, hinge 108 may include a plurality of hinge elements 108*a* disposed on base 102 and a plurality of hinge elements 108*b* (shown in FIG. 2B) disposed on platen 104. Hinge pin 114 may be used to connect the plurality of hinge elements 108*a* and 108*b*.

Figure 2B:
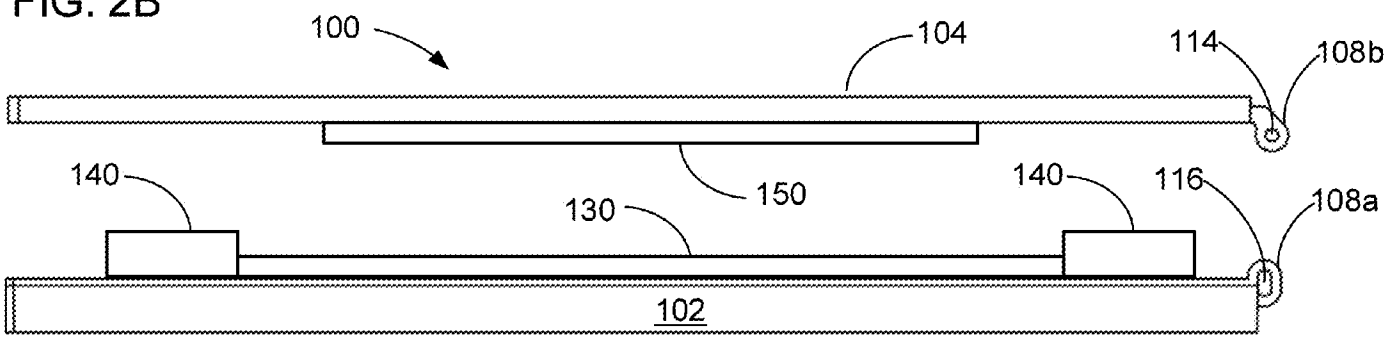
FIG. 2B illustrates an exploded side elevation view of the letterpress assembly illustrated in FIG. 1A.

FIG. 2B illustrates a side elevation view of letterpress assembly 100. As illustrated, hinge elements 108*a* may include an opening 116 for receiving hinge pin 114. Opening 116 may be a slot, or other type of elongated aperture that allows hinge pin 114 a certain amount of vertical travel. In conjunction with spacing members 140, the vertical travel may allow for a separation between printing plate 150 and medium 130 when letterpress assembly 100 is in the closed configuration. Opening 116 may therefore allow the system to provide a more even compressive force between base 102 and platen 104 when these two pieces are compressed together. As discussed above, platen 104 may be partially transparent, and may thus allow a user to view printing plate 150 positioned over medium 130 before the design is applied on medium 130. In this way, a user may confirm the placement of printing plate 150 with respect to medium 130 without inadvertently transferring ink from printing plate 150 to medium 130.

Figure 3A:
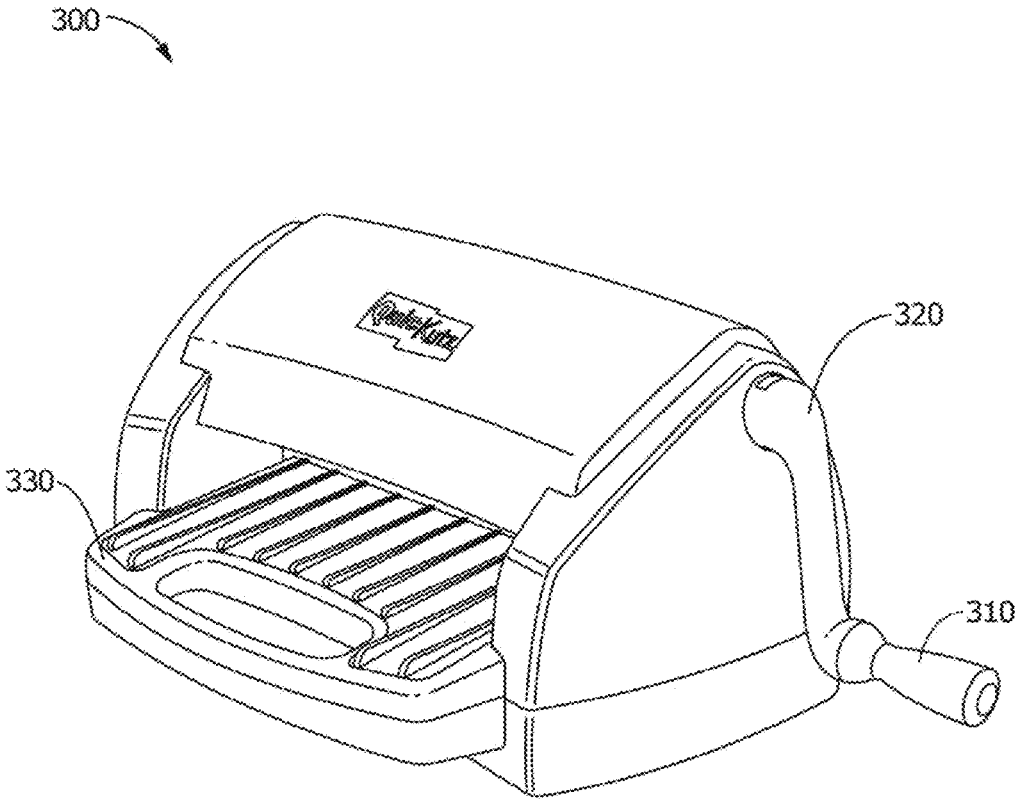
FIG. 3A illustrates a perspective view of one embodiment of a roller assembly with a manual crank.

FIG. 3A illustrates one embodiment of a roller assembly 300. Roller assembly 300 may be configured to receive a letterpress assembly (such as letterpress assembly 100 in FIG. 1), and to exert a compressive force on the letterpress assembly to bring a medium into contact with a printing plate to apply a design from the printing plate onto the medium. In operation, a letterpress assembly in the closed configuration may be placed on guide 330 and received into roller assembly 300. A user may manually rotate a handle 310 about a crank 320. The rotating crank 320 causes rollers (shown at 326 and 328 in FIG. 3B) to rotate. The rotation of the rollers causes the letterpress assembly to move through roller assembly 300.

Figure 3B:
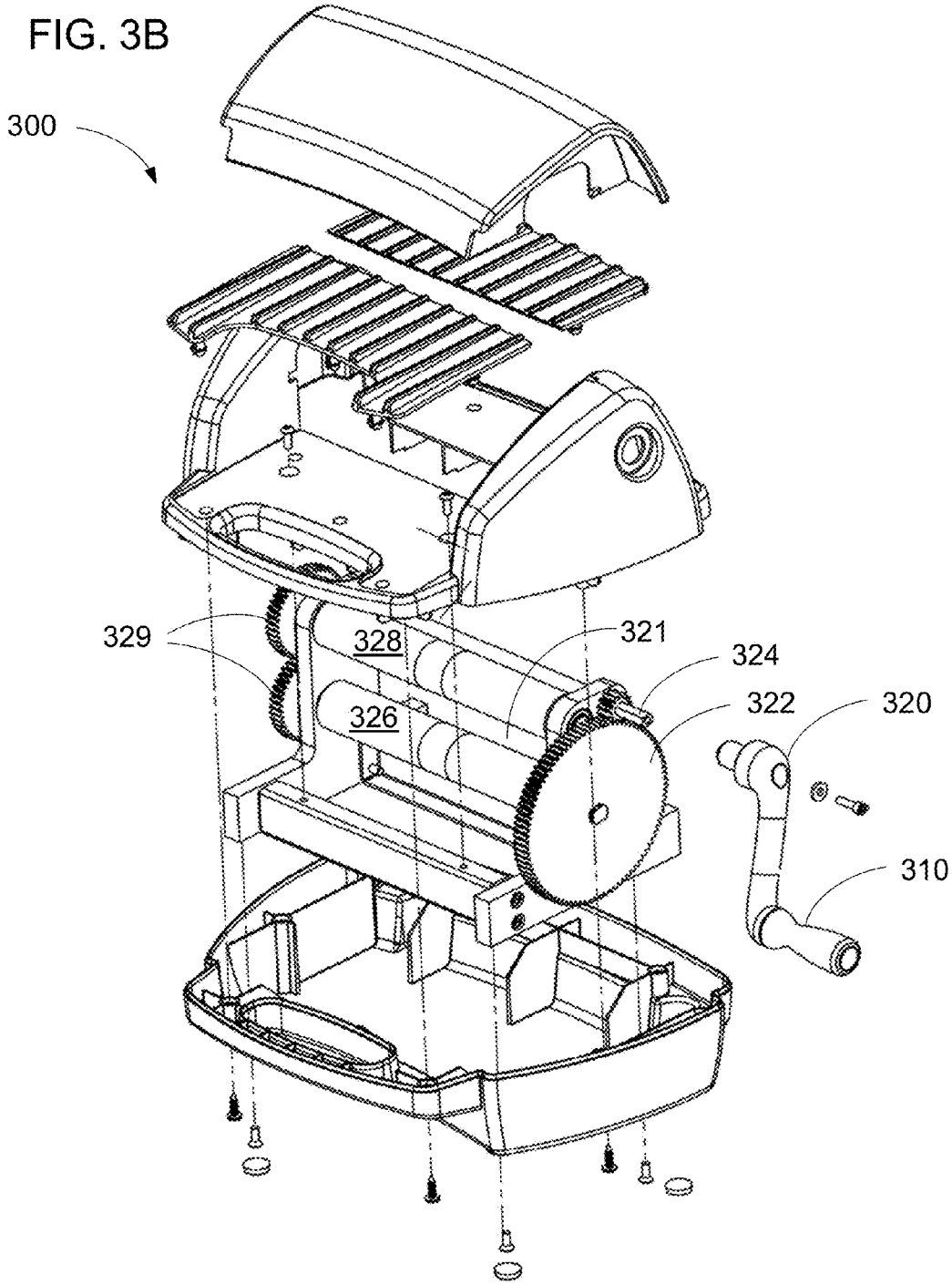
FIG. 3B illustrates an exploded perspective view of the roller assembly illustrated in FIG. 3A.

FIG. 3B illustrates an exploded view of roller assembly 300. Handle 310 is connected to a handle mount 324, which in turn is connected to a gear 322. As handle 310 rotates crank 320, the rotation is transferred to a first roller 326. First roller 326 may be connected to additional gears 329, which transfer the rotation to a second roller 328.

A space 321 between first roller 326 and second roller 328 may be configured to receive the letterpress assembly and rollers 326 and 328 may exert a compressive force on a portion of the letterpress assembly in contact with the rollers. By exerting the compressive force on only a section of the letterpress assembly (e.g., the section received between rollers 326 and 328) the force required to apply a design may be less using a roller assembly than the force that would be required to apply a design to the entire letterpress assembly at the same time. As discussed in greater detail with regard to FIGS. 6 and 7, an adapter may be utilized in cases where the size of space 321 is greater than the thickness of a letterpress assembly.

In certain embodiments, rollers 326 and 328 have a taper between the middle of the roller and an edge of the roller. In other words, the diameter of rollers 326 and 328 in the middle may exceed the diameter of the edges of the rollers at an edge. The taper may be configured to compensate for any bowing or bending that may occur in rollers 326 and 328 when the letterpress assembly is disposed between rollers 326 and 328.

In certain embodiments, crank 320 may operate as a ratchet. In such embodiments, the roller assembly illustrated in FIG. 3B could be modified such that crank 320 moves within a fixed range. Crank 320 may be connected to rollers 328 and 326 such that only one direction of motion of crank 320 results in motion of gears 322 and 329, and rollers 326 and 328. A ratchet (not shown) and a pawl (not shown) may be used in connection with a gearwheel (not shown) to allow motion in only one direction.

Figure 4A:
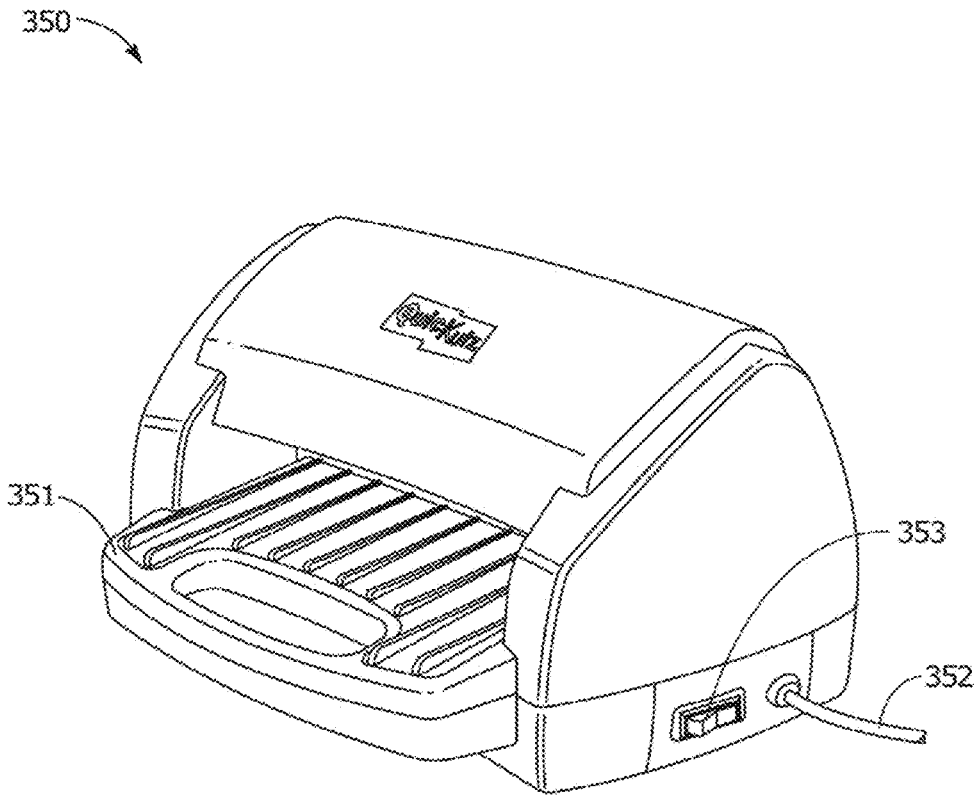
FIG. 4A illustrates a perspective view of an embodiment of a roller assembly with an electric motor.

FIG. 4A illustrates an alternative embodiment of a roller assembly 350, in which an electric motor (shown as ref. no. 354 in FIG. 3D) is configured to turn rollers (shown as ref. no. 355 and 356 in FIG. 3D). Roller assembly 350 includes a guide 351 for receiving a letterpress assembly in the closed configuration and for guiding the letterpress assembly into roller assembly 350. An electrical cord 352 may connect to an outlet (not shown) and provide power to the electrical motor. The electrical motor may be turned on and off using an electrical switch 353.

Figure 4B:
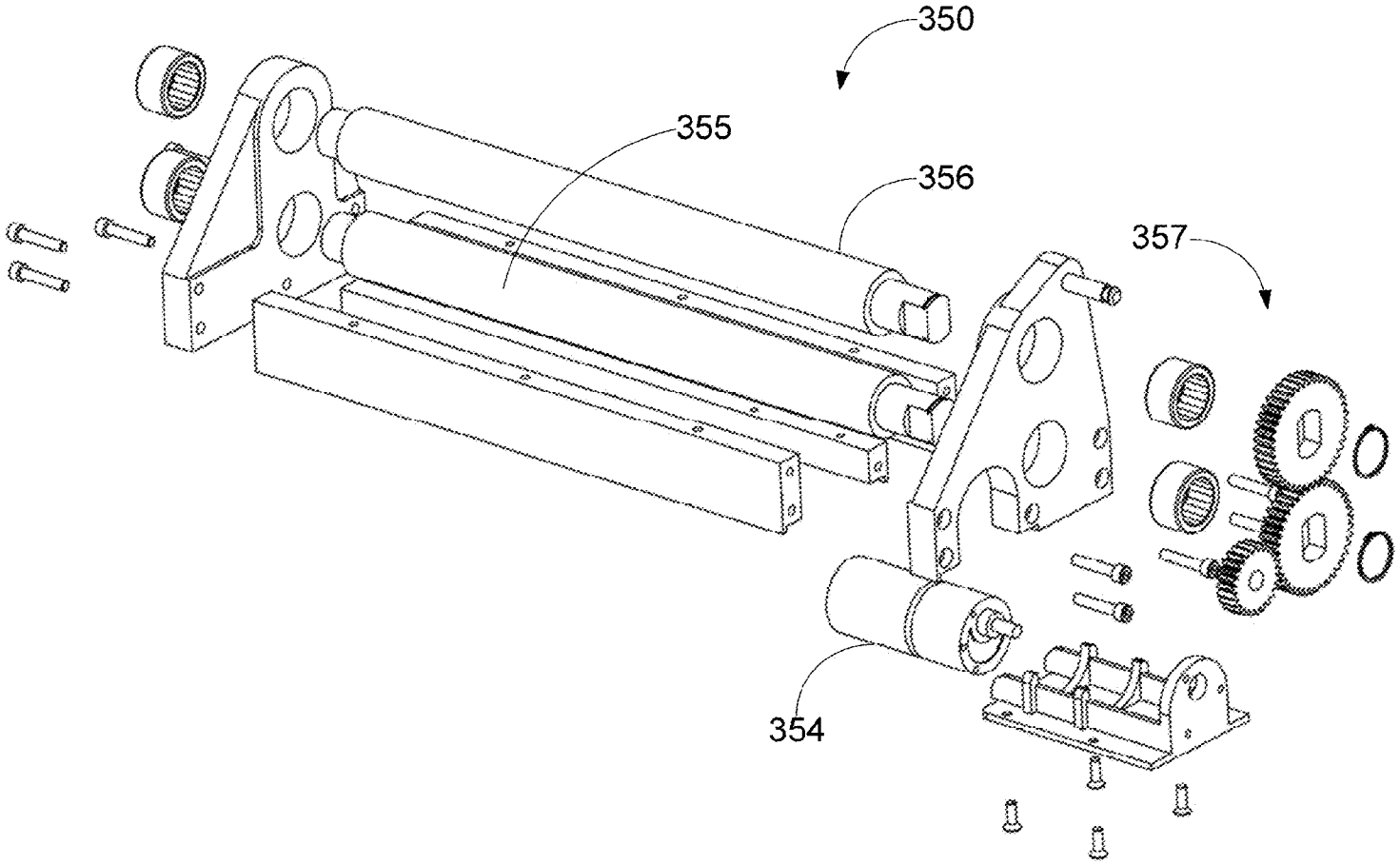
FIG. 4B illustrates an exploded view of a portion of the roller assembly illustrated in FIG. 4A.

FIG. 4B illustrates an exploded view of a portion of a roller assembly 350 illustrated in FIG. 4A. An electrical motor 354 is operable to turn a plurality of gears 357. Gears 357 are coupled to rollers 355 and 356. As electrical motor 354 rotates, the rotation is transferred by gears 357 to rollers 355 and 356. A letterpress assembly may be moved through roller assembly 350 by activating electrical motor 354, which causes roller 355 to rotate with respect to second roller 356, thus drawing the letterpress assembly through roller assembly 350.

Figure 5A:
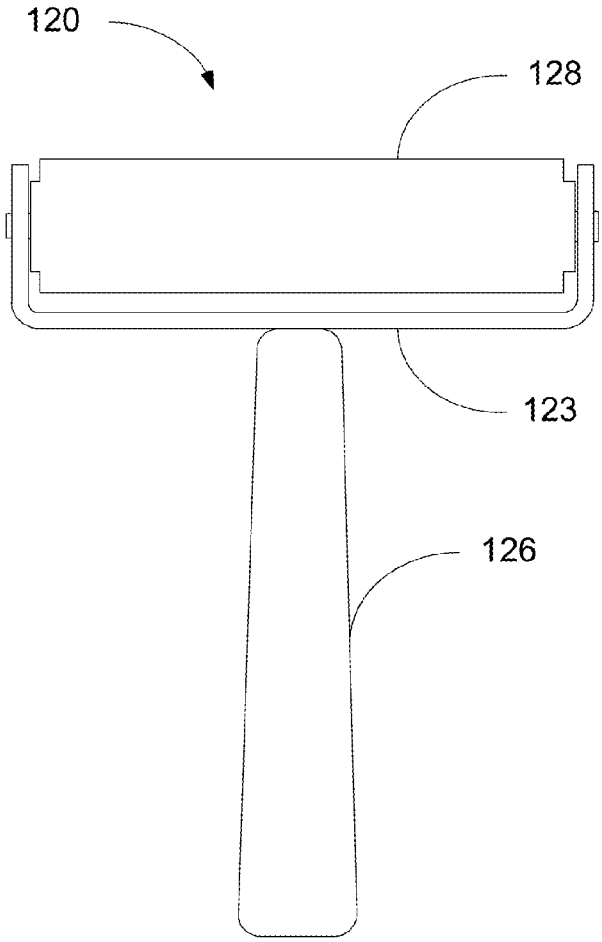
FIG. 5A illustrates a top plan view of one embodiment of an ink brayer.
Figure 5B:
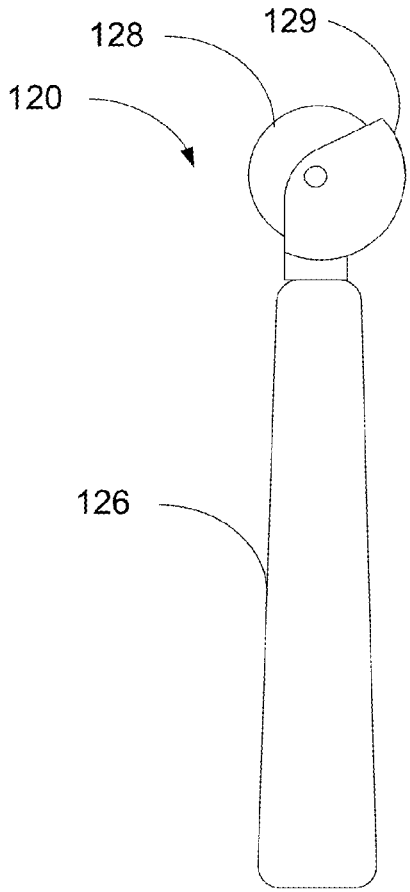
FIG. 5B illustrates a side elevation view of the ink brayer illustrated in FIG. 5A.
Figure 5C:
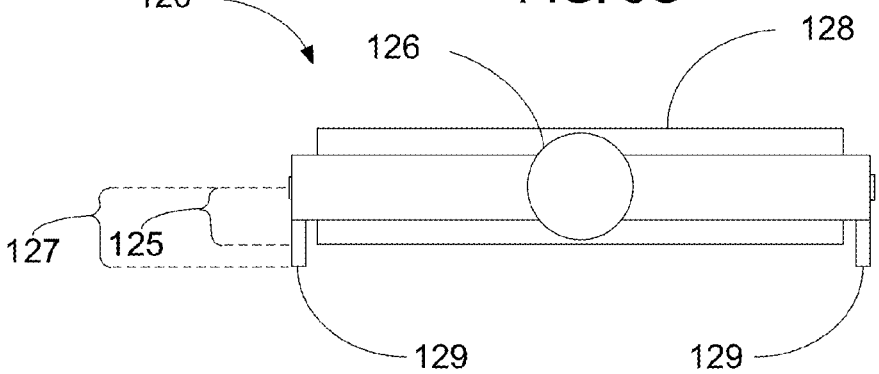
FIG. 5C illustrates a rear elevation view of the ink brayer illustrated in FIG. 5A.

FIG. 5A illustrates a top view of ink brayer 120, which is also shown in FIG. 1A. Ink brayer 120 includes a handle 126 and a support member 123, which connects handle 126 to a cylinder 128. As illustrated in FIGS. 5B and 5C, guides 129 extend beyond cylinder 128. FIG. 5C illustrates that cylinder 128 has a radius indicated by distance 125, while guide 129 has a radius indicated by distance 127. In certain embodiments, the difference between distance 127 and distance 125 is approximately equal to the thickness of a printing plate, which may facilitate the even application of ink on a printing plate, and may avoid unintentional application of ink to the platen and/or the edges of the printing plate. As further illustrated in FIGS. 5B and 5C, guides 129 may be disposed only on one side of cylinder 128. The side of cylinder 128 opposite guides 129 may be used to spread ink on an ink plate and to apply ink to the surface of cylinder 128. When brayer 120 is not in use, guides 129 may be placed on a table or other surface, and may elevate cylinder 128 in order to help prevent the inadvertent transfer of ink to the table or other working surface.

Figure 6:
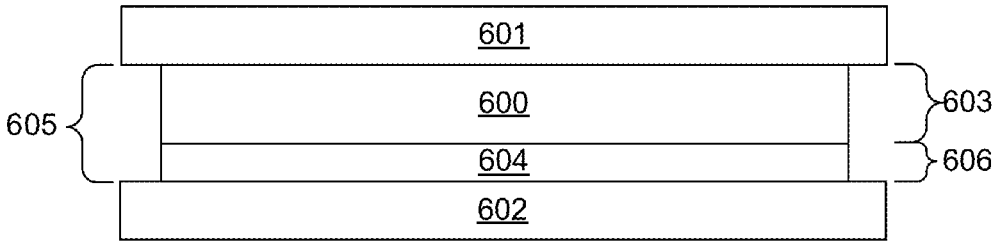
FIG. 6 is a rear elevation view of a letterpress assembly and an adapter disposed between two rollers.

FIG. 6 is a rear elevation view of a letterpress assembly 600 and an adapter 604 disposed between two rollers 601 and 602. As illustrated in FIG. 6 there is a space 605 between roller 601 and roller 602. As illustrated in FIG. 6, a thickness 603 of letterpress assembly 600 is smaller than a space 605 between the rollers 601 and 602. An adapter 604 may be used to compensate for the difference in the thickness of letterpress assembly 600 and the space 605. In other words, adapter 604 may have a thickness 606 approximately equal to the difference between thickness 603 of letterpress assembly 600 and space 605. As may be appreciated, without adapter 604, rollers 601 and 602 would not receive letterpress assembly 600 and exert a compressive force on letterpress assembly 600; however, if adapter 604 is received between rollers 601 and 602 with letterpress assembly 600, a compressive force may be exerted by rollers 601 and 602 on letterpress assembly 600. Adapter 604 may be fabricated of a variety of materials, including plastic, metal, wood, polymers, and the like. Additional materials may also be used for adapter 604 that are able to evenly transfer pressure to letterpress assembly 600.

Figure 7:
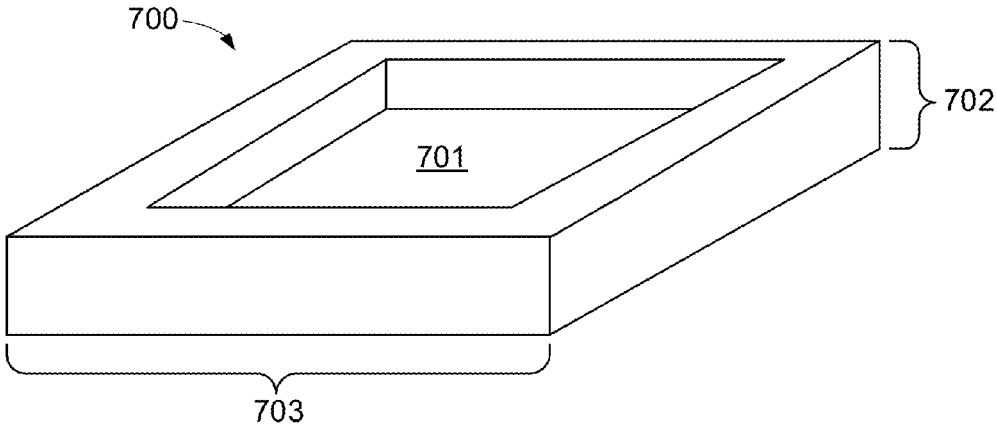
FIG. 7 is a perspective view of one embodiment of an adapter.

FIG. 7 is a perspective view of one embodiment of an adapter 700. Adapter 700 may be configured to receive a letterpress assembly (not shown) in a recess 701. Recess 701 may be configured to receive a variety of letterpress assemblies having a variety of thicknesses and widths. Further, a height 702 and/or a width 703 of adapter 700 may be selected such that adapter 700 is able to adapt a wide variety of existing roller assemblies to receive a letterpress assembly. In one exemplary embodiment, an adapter may be configured to adapt a roller assembly used for producing die cuts to receive a letterpress assembly. Adapter assembly 700 may be manufactured in a plurality of different thicknesses and widths, each size configured to adapt a particular type of roller assembly to receive a letterpress assembly. In other embodiments, an adapter may not include a recess, and instead may simply be flat.

The above description fully discloses the invention including preferred embodiments thereof. Without further elaboration, it is believed that one skilled in the art can use the preceding description to utilize the invention to its fullest extent. Therefore the examples and embodiments disclosed herein are to be construed as merely illustrative and not a limitation of the scope of the present invention in any way.

Those having skill in the art will recognize that many changes may be made to the details of the above-described embodiments without departing from the underlying principles of the present disclosure. The scope of the present invention should, therefore, be determined only by the following claims.

The invention claimed is:

1. A system for applying a design on a medium, the system comprising:

a printing plate comprising a design to be applied on a medium;

a letterpress assembly configurable in an open configuration and a closed configuration, the letterpress assembly comprising:

a first surface configured to receive the medium in the open configuration;

a second surface configured to receive the printing plate in the open configuration;

wherein the medium and the printing plate are separated in the closed configuration;

a roller assembly configured to receive the letterpress assembly and to exert a compressive force on the letterpress assembly in the closed configuration to bring the medium into contact with the printing plate so as to transfer an ink from the printing plate to the medium and to create an impression of the printing plate on the medium.

2. The system of claim 1, further comprising at least one spacing member positionable between the first surface and the second surface and configured to maintain a separation between the first surface and the second surface in the closed configuration.

3. The system of claim 2, wherein the at least one spacing member is compressible by at least 50% when the letterpress assembly is subject to the compressive force exerted by the roller assembly.

4. The system of claim 2, wherein the at least one spacing member comprises:

a first side having an adhesive disposed thereon;

wherein the adhesive is configured to allow the at least one spacing member to be removably adhered to the first surface.

5. The system of claim 1, wherein the first surface is connected to the second surface.

6. The system of claim 5, further comprising a hinge connecting the first surface to the second surface, wherein the hinge is configured to allow the first surface to be moved relative to the second surface with the first surface substantially parallel to the second surface.

7. The system of claim 6, further comprising an opening configured to allow the first surface to be moved relative to the second surface with the first surface substantially parallel to the second surface.

8. The system of claim 1, wherein the printing plate comprises:

a first side having a fastener disposed thereon; and a second side having the design disposed thereon, wherein the fastener is configured to allow the printing plate to be removably attached to the second surface.

9. The system of claim 8, wherein the fastener comprises at least one of a low-tack adhesive, a hook, and a snap.

10. The system of claim 1, wherein at least one of the first surface and the second surface is at least partially transparent.

11. The system of claim 1, further comprising:

a first positioning grid disposed on the first surface; and a second positioning grid disposed on the second surface, wherein at least a portion of the first positioning grid aligns with at least a portion of the second positioning grid in the closed configuration.

12. The system of claim 11, wherein the first positioning grid is identical to the second positioning grid.

13. The system of claim 1, further comprising:

an ink brayer, the ink brayer comprising:

a cylinder having a radius; and a guide that extends beyond the radius of the cylinder.

14. The system of claim 13, wherein the guide extends beyond the radius of the cylinder by a distance at least approximately equal to a thickness of the printing plate.

15. The system of claim 1, wherein the printing plate comprises at least one of a molded plastic plate, a chemically-etched plate, a machined plastic plate, and a photopolymer plate.

16. The system of claim 1, wherein the roller assembly comprises at least one roller having a taper between a middle of the roller and an edge of the roller.

17. The system of claim 1, wherein the roller assembly comprises:

a first roller; and a rotary mechanism configured to cause the first roller to rotate when the rotary mechanism is rotated, wherein the compressive force is exerted on the letterpress assembly by the first roller on a portion of the letterpress assembly in contact with the roller.

18. The system of claim 17, wherein the roller assembly further comprises:

a second roller, wherein the compressive force is exerted on the letterpress assembly by the first roller and the second roller on a portion of the letterpress assembly in contact with the first roller and the second roller.

19. The system of claim 17, wherein the rotary mechanism comprises at least one of a crank, an electric motor, a lever, and a ratchet.

20. The system of claim 1, wherein the medium comprises a first side and a second side, wherein the first surface comprises a packing mat, the packing mat configured such that, when a first side of the medium is oriented toward the printing plate, the first side is debossed when the medium is brought into contact with the printing plate by the compressive force and a second side of the medium oriented toward the packing mat remains substantially flat.

21. The system of claim 1, wherein contact between the medium and the printing plate is configured to cause a transfer of an ink from the printing plate to the medium.

* * * * *